US005924273A

United States Patent [19]

Bertrams et al.

[11] Patent Number: 5,924,273

[45] Date of Patent: Jul. 20, 1999

[54] TEXTILE YARN COP CHANGING AND TRANSPORT SYSTEM

[75] Inventors: Josef Bertrams, Am Sandhang; Paul Straaten, Am Berkmansgraben; Karl-Heinz Bruss, Aktienstrasse, all of Germany

[73] Assignee: W. Schlafhorst AG & Co., Moenchengladbach, Germany

[21] Appl. No.: 08/965,636

[22] Filed: Nov. 6, 1997

[30] Foreign Application Priority Data

Nov. 9, 1996 [DE] Germany ..... 196 46 337

[51] Int. Cl.[6] ..... D01H 9/10

[52] U.S. Cl. ..... 57/281; 57/90; 57/266; 57/273; 57/274; 242/473.4

[58] Field of Search ..... 242/473.4, 473.5, 242/473.6; 57/281, 266, 273, 274, 276, 90

[56] References Cited

U.S. PATENT DOCUMENTS

| | | | |
|---|---|---|---|
| 4,940,192 | 7/1990 | Kuepper et al. | 242/35.5 A |
| 5,179,829 | 1/1993 | Grecksch et al. | 57/90 |
| 5,337,551 | 8/1994 | Grecksch et al. | 57/90 |
| 5,628,174 | 5/1997 | Mack et al. | 57/90 |
| 5,715,669 | 2/1998 | Hasegawa et al. | 57/281 |

FOREIGN PATENT DOCUMENTS

| | | | |
|---|---|---|---|
| 27 27 620 B2 | 4/1979 | Germany . | |
| 32 35 442 C2 | 5/1985 | Germany . | |
| 38 10 785 A1 | 10/1989 | Germany . | |
| 38 13 250 A1 | 11/1989 | Germany . | |
| 39 19 525 A1 | 12/1990 | Germany . | |
| 40 34 824 A1 | 5/1992 | Germany . | |
| 4207050 | 9/1993 | Germany | 57/281 |
| 42 00 798 C2 | 8/1994 | Germany . | |
| 44 38 473 A1 | 5/1996 | Germany . | |

*Primary Examiner*—William Stryjewski

*Attorney, Agent, or Firm*—Kennedy Covington Lobdell & Hickman, LLP

[57] ABSTRACT

A cop changing and transport system for a composite ring spinning and winding machine wherein both the ring spinning machine and the winding machine have respective transport systems 2 and 3 in which circulate separate respective groups of transport pallets 25 and 26, dedicated to the respective machines. A transfer device 1 is disposed at an adjacent location between the transport systems 2 and 3, and has two adjoining transport disks 8, 9 rotating in the same direction. Cop and tube manipulating devices 42 are respectively disposed on the transport disks 8 and 9 on support columns 39 of a support structure 38, which manipulating devices are positively controlled in the course of the rotation of the transport disks 8 and 9 such that the manipulating devices continuously transfer the spinning cops 59 or the empty tubes 60 from the transport pallets of one transport system to the transport pallets of the other transport system.

10 Claims, 5 Drawing Sheets

TEXTILE YARN COP CHANGING AND TRANSPORT SYSTEM

FIELD OF THE INVENTION

The present invention relates generally to a system for exchanging and transporting textile yarn cops and tubes in a composite ring spinning and winding machine, and relates more particularly to such a transport system having a transport sub-system dedicated to the ring spinning machine and a transport sub-system dedicated to the winding machine in each of which circulate transport pallets dedicated to the respective machine and a transfer device disposed at a location between the two transport sub-systems to make possible a transfer of spinning cops and empty tubes from the transport pallets of one sub-system to the transport pallets of the other sub-system.

BACKGROUND OF THE INVENTION

In cheese-producing machines, in particular automatic cheese winding machines, transport systems with circulating transport pallets for conveying cops and tubes have been known for some time. The spinning cops or the empty tubes are releasably secured in a vertical orientation on upstanding pegs on these transport pallets.

As described in German Patent Publication DE 32 35 442 C2, for example, such a transport system can have a connected transport loop, which extends around both the ring spinning machines producing spinning cops and the automatic cheese winding machines processing the spinning cops into large-volume cheeses.

However, such a transport system has the disadvantage that the transport pallets used cannot be optimally matched to the requirements or the conditions of the two textile machines which are a part of the composite machine and are quite different in their structural design. The relatively narrow spindle arrangement of the ring spinning machine, for example, requires transport pallets of a narrow diameter, while in the area of the cheese winding machines transport pallets of a large diameter are more advantageous in the interest of sufficient stability under load.

For this reason transport systems have already been developed in the past to avoid the known disadvantages of the above described installations. For example, a transport installation, which represents the prior art, is described in German Patent Publication DE 39 19 525 A1, wherein a separate transport system for the ring spinning machine and a separate transport system for the automatic cheese winding machine are provided. Separate groups of transport pallets respectively dedicated to the spinning machine transport system or to the winding machine transport system circulate in these separate transport systems. The two transport systems adjoin one another at a common area at which a transfer device is provided to transfer the spinning cops or the empty tubes from the transport pallets of the one transport system to the transport pallets of the other transport system.

Although such transport installations permit the employment of machine-specific transport pallets, the transfer device disposed in the contact area has been problematic in practice in that the transfer devices known so far (e.g., German Patent Publications DE 39 19 525 A1, DE 40 34 824 A1) either operate discontinuously, which has a disadvantageous effect on the throughput volume of the installation, or are relatively expensive in structural design and prone to malfunctions.

For example, German Patent Publication DE 44 38 473 A1 shows a transfer device wherein each one of the numerous gripper elements arranged on a rotating disk is seated vertically displaceable by means of its own push-piston gear. Thus, during operation the individual push-piston gears which actuate the gripper elements are sequentially triggered and lift the spinning cops from the bolt-like tube supports of a first transport system and transfer them to the transport pallets of an intersecting transport device.

OBJECT AND SUMMARY OF THE INVENTION

In light of the above mentioned prior art, it is accordingly an object of the present invention to improve the known cop changing and transport systems to avoid the described disadvantages of the prior transport systems.

This object is attained in accordance with the present invention by providing a cop changing and transport system for a composite ring spinning machine and winding machine, wherein a transport sub-system is associated with the ring spinning machine in which transport pallets dedicated to the spinning machine convey yarn-wound spinning cops and empty cop tubes and a transport sub-system is associated with the winding machine in which transport pallets dedicated to the winding machine convey yarn-wound spinning cops and empty cop tubes. A transfer device is disposed between the two transport systems for transferring the spinning cops and empty cop tubes from the transport pallets of one system to the transport pallets of the other system. In accordance with the present invention, the transfer device basically comprises two adjacent transport disks which rotate in the same direction, with cop and tube manipulating devices disposed on each transport disk for lifting and lowering the spinning cops and the empty tubes relative to their respective transport pallets. Each of the transport disks have carrier elements arranged on their outer circumference to pass through a transport path area common to both transport systems in the course of rotation of the transport disk.

This transfer device in accordance with the present invention makes it possible to obtain the advantages of the known cop changing and transport systems used in connection with composite ring spinning and winding machines which utilize separate transport systems in the area of the ring spinning machine and the area of the winding machine, while at the same time avoiding the disadvantages of such cop changing and transport systems.

Thus, separate groups of transport pallets dedicated to the respective machines are used, and are optimally matched to the different requirements of the textile machines involved, while at the same time a large throughput volume of the system is assured because of the continuous operation of the transfer device in accordance with the invention.

In this case the transfer device with its two simultaneously-rotating adjoined transport disks and its positively controlled cop and tube manipulating devices is distinguished by a rugged construction, which is not prone to malfunctions. The transport disks have carrier elements disposed at equal angular distances about the disk circumference which, during one disk rotation, pass through a transport track area of the transport system associated with the ring spinning machine as well as a transport track area of the transport system associated with the winding machine. In this manner, it is possible to convey machine-specific transport pallets of both transport systems simultaneously, but on separate transport paths.

In a preferred embodiment, the cop and tube manipulating devices are actuated by means of stationarily arranged control cranks. The control cranks are preferably embodied in the shape of cylindrical jackets, respectively have an upper and a lower radial cam surface. In the course of one revolution of the transport disk, the elevational displacement of base bodies of the cop and manipulating devices and therefore the vertical displacement of the tubes or cops is initiated by means of the upper control cam, while at the same time associated tube foot positioning or tube gripper devices are actuated by means of the lower control cam.

In a preferred embodiment, a single drive unit is utilized for the entire transfer device, the drive unit preferably comprising one electric motor interlockingly connected by means of a toothed belt with both transport disks. In the course of the rotation of these two transport disks, the cop and tube manipulating devices disposed on the transport disks are positively triggered via the stationarily disposed control cranks, whereby a simple and cost-effective construction results in respect to the outlay for controls.

Guide elements are preferably disposed in the area of the two transport disks, which assure that during the passage of the two groups of machine-specific transport pallets through the transfer device, no mixing of the different transport pallets occurs.

In a preferred embodiment, a support structure, for example in the form of a support column arrangement, is mounted on each transport disk. The base bodies of the cop and tube manipulating devices are respectively fixed at the individual support columns to be vertically movable, preferably by means of parallel guide arms. A particularly rugged construction is achieved by providing a control roller disposed on the rear of the base body and stationarily arranged on the upper control cam surface, which furthermore assures that the cop and tube manipulating devices are always lifted or lowered in accordance with their function.

According to another feature of the present invention, the base body of the cop and tube manipulating devices has a device for positioning the tube foot as well as a device for grasping the tube in the area of the tube tip. The two devices are mechanically coupled via a control rod, to assure in a simple manner that both devices always activate at the same time.

Preferably, the tube gripper, which is mechanically actuated by means of the control rod, is designed as an external gripper having a movable gripper arm which can be pivoted against a fixed stop and in the process acts exteriorly on the tube tip.

Further features and details of the present invention will be recognized and understood from an exemplary embodiment described hereinbelow with reference to the accompanying drawings.

DETAILED DESCRIPTION OF THE PREFERRED EMBODIMENT

Figure 1:
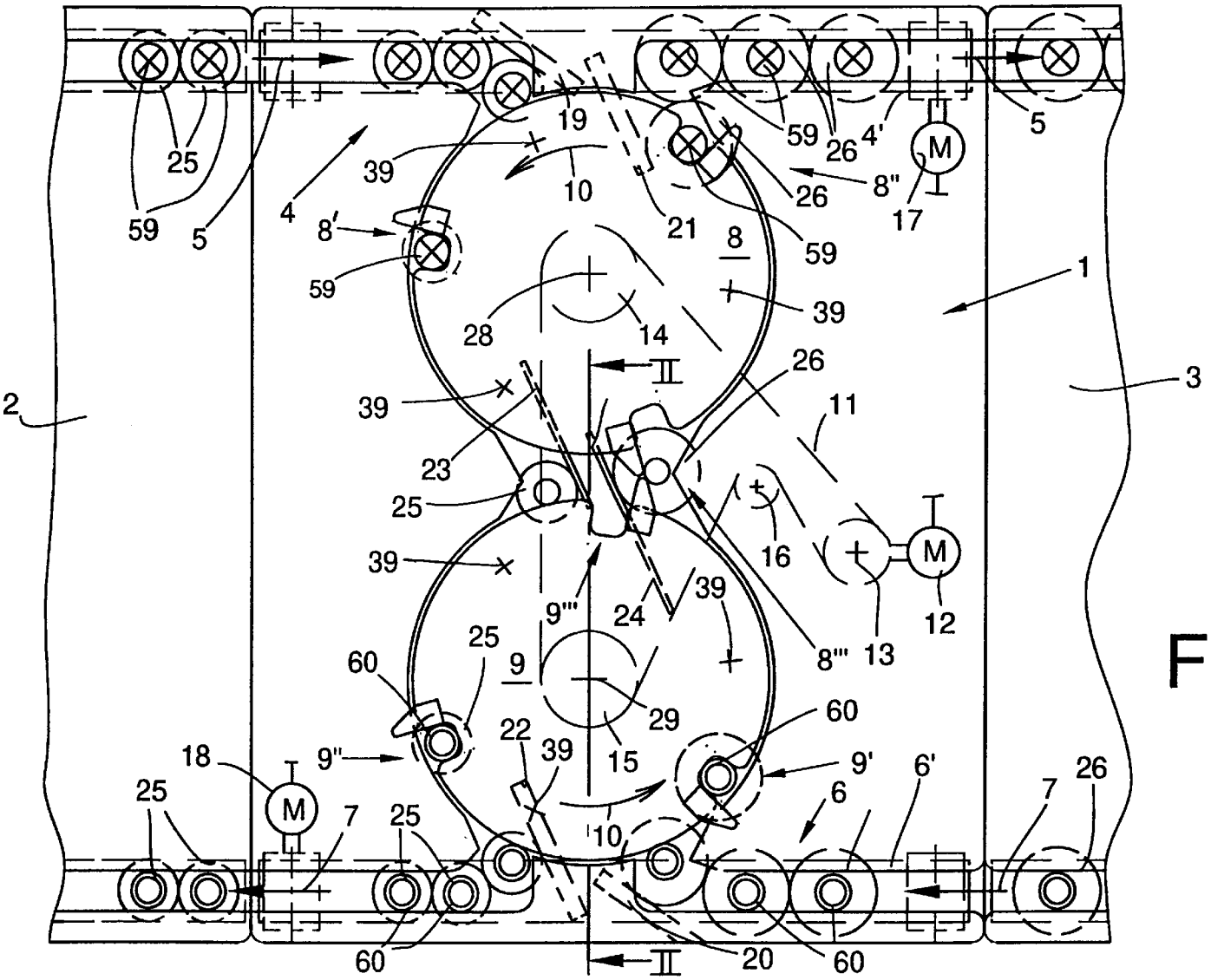
FIG. 1 is a top plan view of a transfer device in accordance with a preferred embodiment of the present invention.

Referring now to the accompanying drawings and initially to FIG. 1, a transfer device 1 comprised of two transport disks 8, 9 for transferring yarn cops and empty spinning tubes between a spinning machine transport system and a winding machine transport system in accordance with the present invention is represented in a top view in FIG. 1, wherein a representation of a cop and tube manipulating device 42 disposed on the transport disks 8, 9 has been omitted for reasons of clarity.

The transfer device 1 is disposed between the transport system 2 of a ring spinning machine (not represented) and the separate transport system 3 of a winding machine (also not represented), and has two outer, preferably linearly extending transport tracks 4 and 6. The transport disks 8 and 9 are arranged between the transport tracks 4 and 6 and rotate in the same direction as indicated by the directional arrows 10 in FIG. 1, with each transport disk 8, 9 respectively having a plurality of carrier elements 8', 8", 8'" and 9', 9", 9'", which are disposed on their outer circumference preferably offset by about 120°. The transport disks 8, 9 are connected with a drive unit 12 via a drive element 11, for example an endless toothed belt or a roller chain, which travels about appropriate gear wheels 13, 14, 15 and a reversing wheel 16.

Endless transport belts 4', 6' are driven by electrical drives 17, 18 to travel along the outer transport tracks 4 and 6 in the direction of the respective arrows 5, 7. The transport tracks 4 and 6 extend tangentially with respect to the respective transport disk 8, 9, and in this area the transport tracks 4, 6 have respective fender elements 19, 21 and 20, 22. Similar fender elements 23 and 24 are also arranged in the area between the transport disks 8 and 9. Thus, the transport path of the transport pallets 25 specifically dedicated to the spinning machine is determined by the fender elements 19, 23, 22, while the fender elements 20, 24, 21 control the transport path of transport pallets 26 specifically dedicated to the winding machine.

Figure 2:
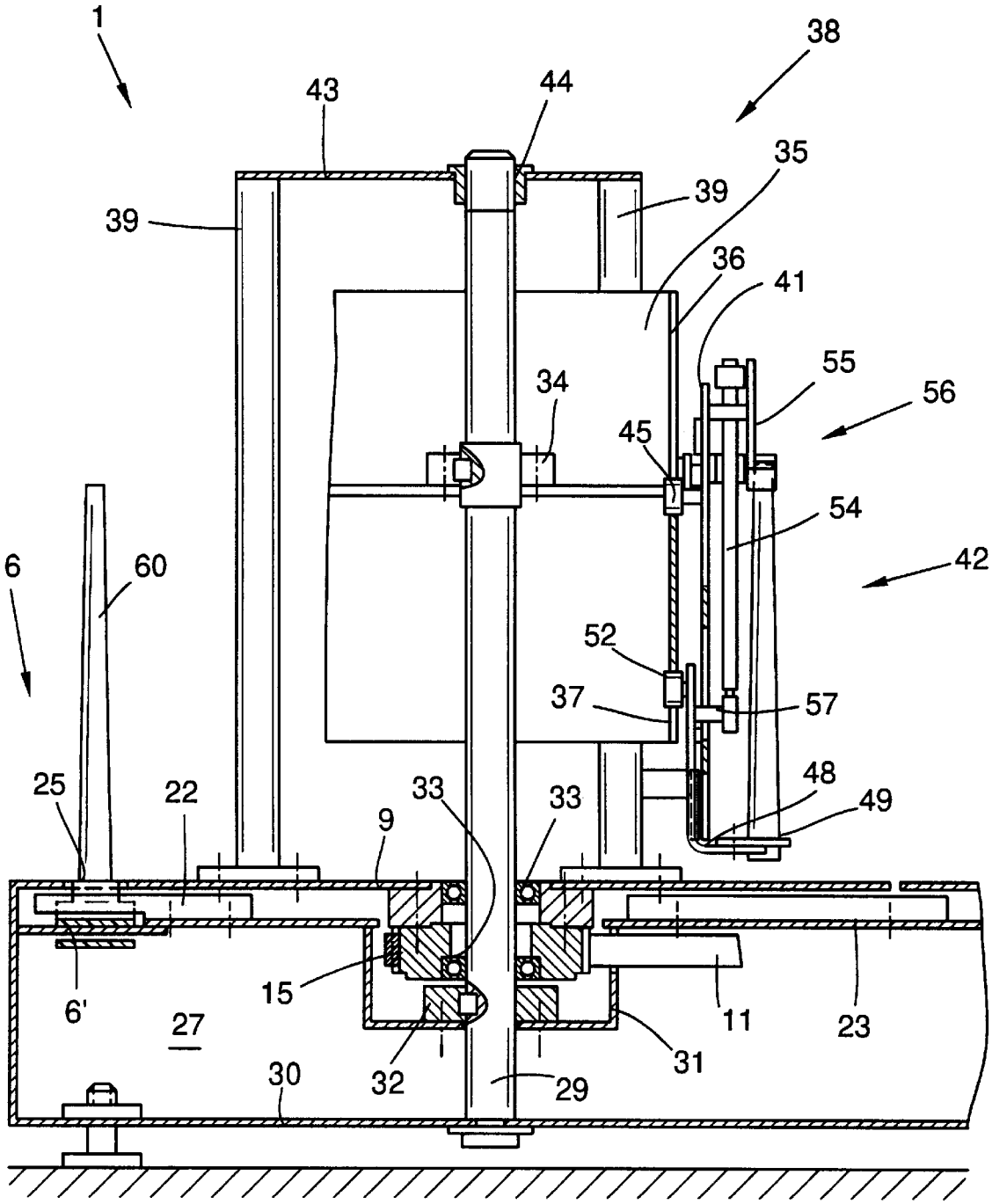
FIG. 2 is a lateral side elevational view of a transport disk of the transfer device of FIG. 1 taken along the section line II—II therein, showing a cop and tube manipulating device arranged on a support column.
Figure 3:
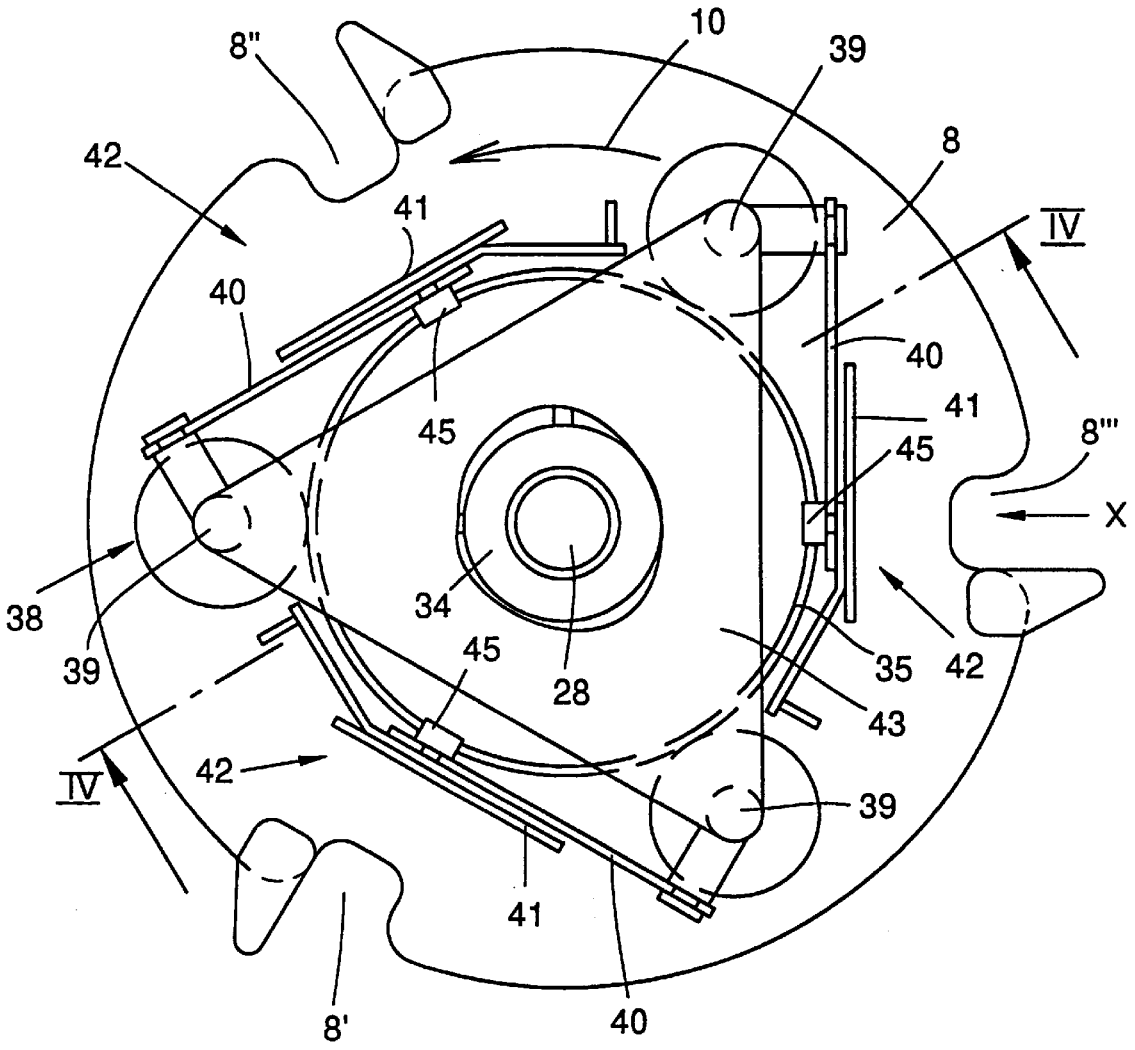
FIG. 3 is a top view of a transport disk of the transfer device of FIG. 1, showing its support structure and schematically indicated cop and tube manipulating devices arranged on the support columns.

FIG. 2 represents a lateral view of the transfer device 1 in accordance with the invention, taken along the section line II—II in FIG. 1. As represented, the transfer device 1 has a chassis 27, assembled from a plurality of flexible sheet metal elements. The transport disks 8 and 9 are rotatably arranged on bearing journal shafts 28 and 29 in this chassis 27. Since the arrangement and structure of the transfer device 1 in the area of the bearing journal shaft 28 for the transport disk 8 and in the area of the bearing journal shaft 29 for the transport disk 9 are identical, only the area of the bearing journal shaft 29 will be described below.

As can be seen from FIG. 2, the bearing journal shaft 29 is fixed at one end in a base plate 30 of the chassis 27 and is fixed at an upward spacing therefrom in an upwardly opening recess 31 of the chassis 27 via a member 32 mounted in the recess 31 to retain the shaft 29 against relative rotation with respect to the chassis 27. The transport disk 9 is seated rotatably on the bearing journal shaft 29 by means of a bearing 33 mounted thereabout. The gear wheel 15 is fixed to the underside of the transport disk 9 encircling the bearing 33 and is connected with the drive unit 12 via the drive belt 11.

A control crank 35 formed in the shape of a cylindrical jacket is fixed to the bearing journal shaft 29 via a support element 34 to be stationary relative to the rotatability of the transport disk 9. The control crank 35 is formed with an upper control cam surface 36 and a lower control cam surface 37.

A support structure 38 is fixed rigidly on the rotatably seated transport disk 9 to rotate unitarily therewith. The support structure 38 is comprised of a number of support columns 39 (in the present exemplary embodiment, three support columns 39 are provided in a circular arrangement respectively spaced from one another approximately 120°) as well as a cover plate 43 affixed to the upper ends of the columns 39, with a sliding bearing 44 mounted to the cover plate 43 being rotatably supported on the bearing journal 29. As can be seen by way of example from FIGS. 2–5, each support column 39 pivotably carries a pair of parallel guide arms 40 onwhich is supported a base body 41 of a cop and tube manipulating device 42 for selective vertical adjustable movement of the cop and tube manipulating device.

Figure 4:
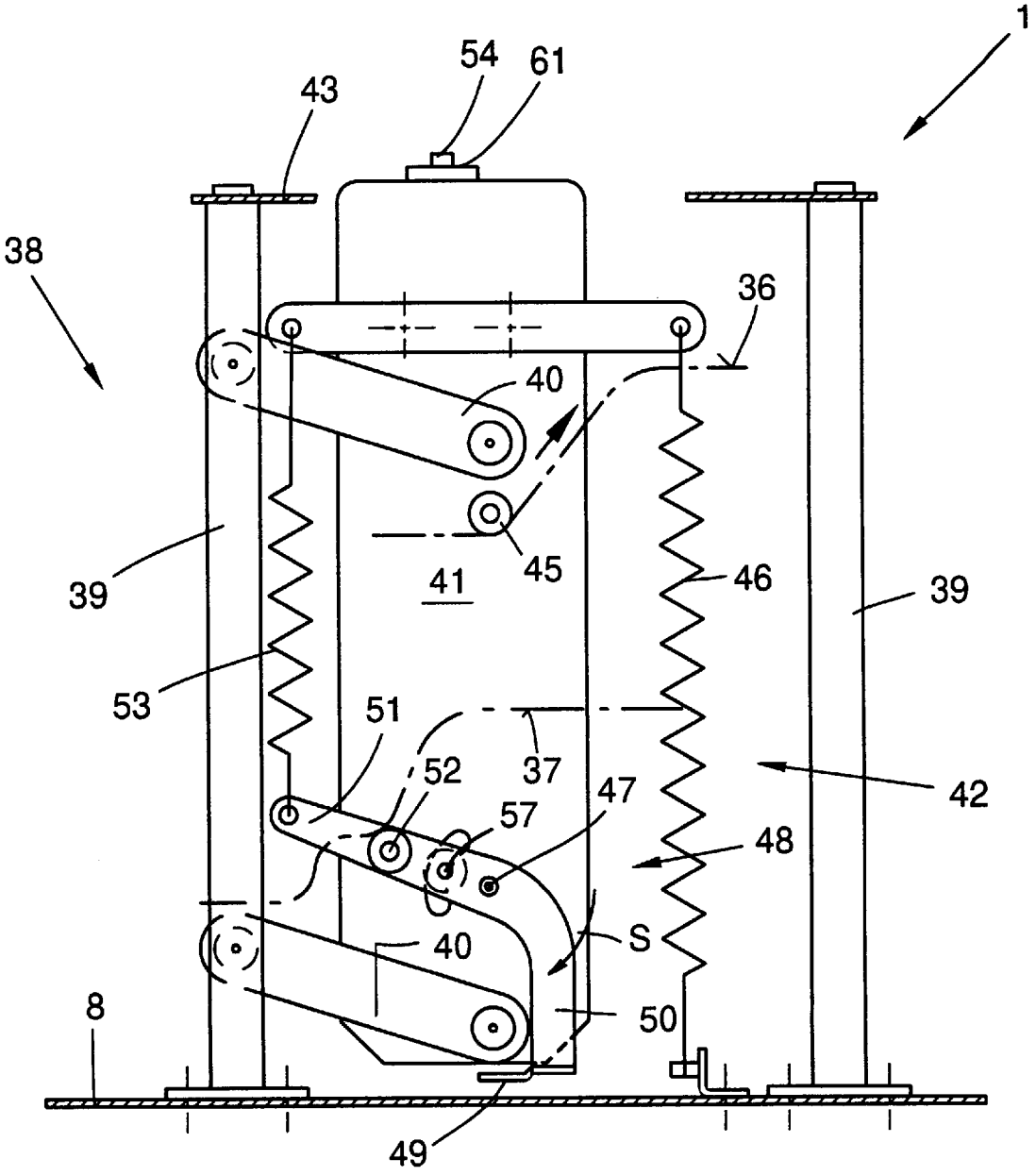
FIG. 4 is a rear elevational view of one of the cop and tube manipulating devices of FIG. 3 taken along the section line IV—IV therein.
Figure 5:
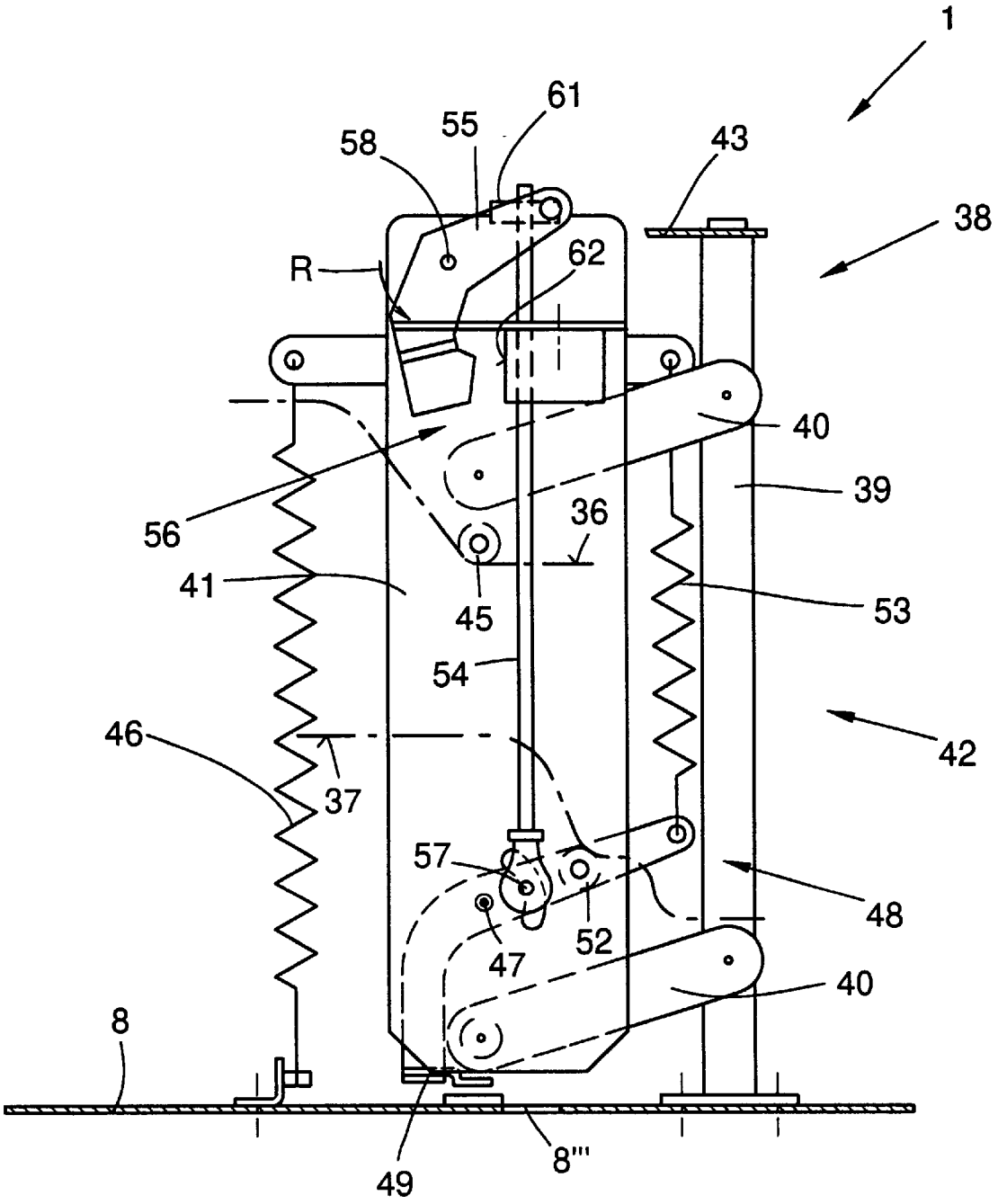
FIG. 5 is a front elevational view of the cop and tube manipulating device taken from the perspective of the arrow X therein.

FIGS. 4 and 5 illustrate a cop and tube manipulating device 42 in detail, FIG. 4 depicting a rear view of a cop and tube manipulating device 42 and FIG. 5 showing a front view thereof.

As already indicated above, the base body 41 of each cop and tube manipulating device 42 is hinged to be vertically pivotable via parallel guide arms 40 on a respective one of the support columns 39, which in turn are fixed in place on the transport disk 9. A control roller 45 is disposed on the rear of each base body 41 and rests on the upper control cam surface 36 of the associated stationary control crank 35 by which the entire cop and tube manipulating device 42 is raised and lowered according to the profile of the cam surface 35 in the course of the rotation of the transport disk 9. The control roller 45 is maintained in following relation against the control cam surface 36 by means of a biasing spring element 46.

An angular lever 48 defining two angularly oriented lever arms 50, 51 is pivoted at a medial location therealong for limited movement about a pivot shaft 47 on each base body 41. The lever 48 has a sheet metal guide piece 49 projecting from the end of its lever arm 50 in the direction toward the transport disk 9 such that, in the course of the displacement of the lever 48 in the direction S (FIG. 4), the guide piece 49 comes into contact with the lower foot portion of a yarn tube (which may be either an empty tube without yarn thereon or wound with yarn as a spinning cop) to manipulate and thereby position the tube foot. The opposite lever arm 51 of the angular lever 48 is biased by a spring element 53 and carries a control roller 52 which rests against the lower control cam surface 37 of the stationary control crank 35. The lever 48 is additionally connected via a control rod 54 with a pivotably seated gripper arm 55 of an external tube gripper 56 (FIGS. 1 and 5).

As can be seen in FIG. 5 in particular, the lower end of the control rod 54 is connected via a pivot shaft 57 with the lever 48, and the upper end of the control rod 54 is connected via a clamping element 61 with the gripper arm 55 of the external tube gripper 56. Thus, when the lever 48 is pivoted via the action of the control roller 52 following the cam surface 37 as the transport disk rotates, the exterior tube gripper 56 is actuated at the same time via the control rod 54, whereby when the sheet metal guide piece 49 is brought into contact with the tube foot, the gripper arm 55 is simultaneously pivoted around the pivot shaft 58 in the direction R into contact with the tube tip to press it against a fixed stop 62.

The functioning of the cop changing and transport system in accordance with the present invention may thus be understood. As shown in FIG. 1, transport pallets 25 dedicated to the spinning machine, on which yarn-wound spinning cops 59 stand in a vertical orientation, are delivered via the transport system 2 of the ring spinning machine onto the transport track 4 of the transfer device 1 and thereby into the area of the rotating transport disk 8. At the same time, transport pallets 26 dedicated to the winding machine carrying empty cop tubes 60 are delivered via the transport system 3 of the winding machine to the transport track 6 which conveys these winding machine transport pallets 26 into the area of the rotating transport disk 9.

The incoming spinning machine-specific transport pallets 25 are deflected in the direction toward the transport disk 8 by the fender element 19 extending into the transport track 4, and are received and conveyed one-by-one by the carrier elements 8', 8", 8'" in the direction of the arrow 10 toward the transport disk 9. The same process occurs at the same time in the area of the transport disk 9. The incoming winding machine-specific transport pallets 26 are deflected by the fender element 20 to be received and grasped one-by-one by the carrier elements 9', 9", 9'" of the transport disk 9 and conveyed thereby toward the transport disk 8 in the direction of the arrow 10.

During the transport of the spinning machine-specific transport pallets 25 by the transport disk 8, the spinning cops 59 are lifted off the spinning machine transport pallets 25 by the cop and tube manipulating devices 42 arranged on the transport disk 8. Likewise, during the transport of the winding machine-specific transport pallets 26 by the transport disk 9, the empty tubes 60 are lifted off the winding machine transport pallets 26 by the cop and tube manipulating devices 42 arranged on the transport disk 9.

After rotation of the transport disk 8 by approximately 180°, the spinning cops 59 which have been lifted off the spinning machine transport pallets 25 are placed one-by-one at the opposite side of the transport disk 8 by its associated cop and tube manipulating devices 42 onto winding machine-specific transport pallets 26, which in the meantime have been relieved of their empty tubes 60 by means of the corresponding cop and tube manipulating devices 42 on the transport disk 9 and have been deflected from the transport disk 9 via the fender element 24 into the carrier elements 8', 8", 8'" of the transport disk 8.

In the same manner, the empty tubes 60 removed from the transport pallets 26 by the cop and tube manipulating devices 42 of the transport disk 9 are correspondingly placed one-by-one onto the now empty spinning machine-specific transport pallets 25, which in the meantime have been deflected via the fender element 23 into the carrier elements 9', 9", 9'" of the transport disk 9. Subsequently the transport pallets 25, now equipped with empty tubes 60, are conveyed by the transport disk 9 to the fender element 22 which deflects the transport pallets 25 onto the transport track 6 to be conveyed in the direction of the arrow 7 toward the transport system 2 of the ring spinning machine.

As already mentioned above, the winding machine-specific transport pallets 26, which are also temporarily empty following the removal of the empty tubes 60 via the cop and tube manipulating devices 42 on the transport disk 9, are transferred via the fender element 24 to the carrier elements 8', 8" or 8'" of the transport disk 8 and receive the spinning cops 59 which had been previously removed from the spinning machine-specific transport pallets 25 by cop and tube manipulating devices 42 arranged on the transport disk 8. Subsequently, the transport pallets 26, now equipped with spinning cops 59, are conveyed by the transport disk 8 to the transport track 4 and deflected thereonto via the fender element 21 to be removed by the transport belt section 4' traveling in the direction of the arrow 5 toward the transport system 3 of the winding machine.

The invention is not limited to the represented exemplary embodiment. Further variants in the structural design of the transfer device are easily conceivable. It is important for the invention that a continuous transfer of the spinning cops delivered by spinning machine-specific transport pallets to winding machine-specific transport pallets takes place, or that the empty tubes delivered by winding machine-specific transport pallets are continuously transferred to the spinning machine-specific transport pallets.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been derelation to it in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A cop changing and transport system for a composite ring spinning machine and winding machine, comprising a transport sub-system associated with the ring spinning machine in which transport pallets dedicated to the spinning machine convey yarn-wound spinning cops and empty cop tubes, a transport sub-system associated with the winding machine in which transport pallets dedicated to the winding machine convey yarn-wound spinning cops and empty cop tubes, and a transfer device disposed between the two transport sub-systems for transferring the spinning cops and empty cop tubes from the transport pallets of one sub-system to the transport pallets of the other sub-system, the transfer device comprising two adjacent transport disks which rotate in the same direction, cop and tube manipulating devices disposed on each transport disk for lifting and lowering the spinning cops and the empty tubes relative to their respective transport pallets, each of the transport disks having carrier elements arranged on their outer circumference to pass through a transport path area common to both transport sub-systems in the course of rotation of the transport disk.

2. The cop changing and transport system in accordance with claim 1, wherein the transfer device comprises stationarily disposed control cranks for actuating the cop and tube manipulating devices.

3. The cop changing and transport system in accordance with claim 2, wherein each cop and tube manipulating device comprises a tube foot positioning device for engaging and positioning a foot of a tube and a tube gripper device for grasping a spaced portion of a tube being positioned by the tube foot positioning device, and each control crank comprises an upper control cam surface for controlling vertical displacement of the cop and tube manipulating devices and a lower control cam surface for actuating the tube foot positioning device and the tube gripper device.

4. The cop changing and transport system in accordance with claim 3, wherein the transfer device comprises an arrangement of support columns on each of the transport disks for supporting the cop and tube manipulating devices, and each of the cop and tube manipulating devices comprises a base body for supporting the tube foot positioning device and the tube gripper device and parallel guide arms movably affixed to each of the support columns with the base body, disposed on the guide arms for height adjustable movement of the base body the tube foot positioning device and the tube gripper device.

5. The cop changing and transport system in accordance with claim 4, wherein the transfer device comprises a control roller disposed on each base body in following engagement with the upper control cam of the associated stationary control crank.

6. The cop changing and transport system in accordance with claim 4, wherein the tube foot positioning device comprises a lever movable around a pivot shaft on each base body, the lever having a guide element for positioning the tube foot and a control roller for following engagement with the lower control cam for actuating movement of the lever.

7. The cop changing and transport system in accordance with claim 6, wherein the transfer device comprises a tube gripper device and a control rod mechanically coupling the lever with the tube gripper device.

8. The cop changing and transport system in accordance with claim 7, wherein the tube gripper device is configured for externally gripping tubes.

9. The cop changing and transport system in accordance with claim 1, wherein the transfer device comprises a common drive unit for continuously driving the two transport disks.

10. The cop changing and transport system in accordance with claim 1, wherein the transfer device comprises guide elements disposed in the area of the transport disks for guiding movement of the spinning machine transport pallets along the transport path thereof and for guiding movement of the winding machine transport pallets along the transport path thereof.

* * * * *